US008998197B2

(12) United States Patent
Murashima

(10) Patent No.: US 8,998,197 B2
(45) Date of Patent: Apr. 7, 2015

(54) SHEET STACKING DEVICE AND IMAGE FORMING APPARATUS PROVIDED WITH SAME

(71) Applicant: KYOCERA Document Solutions Inc., Osaka-shi, Osaka (JP)

(72) Inventor: Masaki Murashima, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 13/972,592

(22) Filed: Aug. 21, 2013

(65) Prior Publication Data

US 2014/0062002 A1 Mar. 6, 2014

(30) Foreign Application Priority Data

Aug. 29, 2012 (JP) ..... 2012-188846

(51) Int. Cl.

| | |
|---|---|
| ***B65H 31/00*** | (2006.01) |
| ***G03G 15/00*** | (2006.01) |
| ***B65H 31/02*** | (2006.01) |
| ***B65H 43/06*** | (2006.01) |

(52) U.S. Cl.

CPC ..... *B65H 31/00* (2013.01); *G03G 15/6552* (2013.01); *B65H 31/02* (2013.01); *B65H 43/06* (2013.01); *G03G 2215/00421* (2013.01); *G03G 2215/00628* (2013.01); *G03G 2215/00729* (2013.01); *B65H 2301/4212* (2013.01); *B65H 2405/111* (2013.01); *B65H 2511/30* (2013.01); *B65H 2511/515* (2013.01); *B65H 2553/612* (2013.01)

(58) Field of Classification Search

USPC ..... 271/145, 207; 399/405

See application file for complete search history.

(56) References Cited

U.S. PATENT DOCUMENTS

| | | | | |
|---|---|---|---|---|
| 5,743,522 | A * | 4/1998 | Rubscha et al. | 271/265.02 |
| 6,986,509 | B2 * | 1/2006 | Koh et al. | 271/110 |
| 7,270,324 | B2 * | 9/2007 | Ogata et al. | 271/220 |

(Continued)

FOREIGN PATENT DOCUMENTS

| | | |
|---|---|---|
| JP | 63-11464 | 1/1988 |
| JP | 2002-167119 | 6/2002 |

(Continued)

OTHER PUBLICATIONS

Japanese Office Action issued on Jan. 6, 2015.

*Primary Examiner* — Ernesto Suarez

(74) *Attorney, Agent, or Firm* — Gerald E. Hespos; Michael J. Porco; Matthew T. Hespos

(57) ABSTRACT

A sheet stacking device includes a device main body, a sheet discharge unit, a sheet stacking portion and a sheet detector. The sheet discharge unit discharges sheets. The sheet stacking portion includes a sheet stacking surface on which the sheets are to be stacked. The opening is formed in the sheet stacking surface. The sheet detector includes a detection piece capable of projecting upwardly of the sheet stacking surface from the opening. The sheet detector detects a first state, a second state and a third state. The first state is a state where no sheet is placed on the sheet stacking surface. The second state is a state where a first number of the sheets discharged are placed on the sheet stacking surface. The third state is a state where a second number of the sheets larger than the first number are placed on the sheet stacking surface.

10 Claims, 12 Drawing Sheets

(56) References Cited

U.S. PATENT DOCUMENTS

| | | | | |
|---|---|---|---|---|
| 7,865,127 | B2 * | 1/2011 | Nakajima | 399/406 |
| 2005/0141939 | A1 | 6/2005 | Kayama et al. | |
| 2014/0001702 | A1 * | 1/2014 | Wu | 271/207 |

FOREIGN PATENT DOCUMENTS

| | | |
|---|---|---|
| JP | 2004-299882 | 10/2004 |
| JP | 2010-6564 | 1/2010 |

* cited by examiner

SHEET STACKING DEVICE AND IMAGE FORMING APPARATUS PROVIDED WITH SAME

This application is based on Japanese Patent Application Serial No. 2012-188846 filed with the Japan Patent Office on Aug. 29, 2012, the contents of which are hereby incorporated by reference.

BACKGROUND

The present disclosure relates to a sheet stacking device for stacking sheets and an image forming apparatus provided with the same.

Conventionally, a technique for forming a toner image on a photoconductive drum and transferring the toner image to a sheet in a transfer unit is known as an image forming apparatus for forming an image on a sheet. The image forming apparatus includes a fixing unit and a sheet having a toner image transferred thereto is discharged after a fixing process is applied in the fixing unit.

A sheet stacking device including a sheet discharge portion is further arranged in the image forming apparatus as described above. Sheets, to which the fixing process was applied, are successively discharged and stacked on the sheet discharge portion. An actuator including a detection piece is arranged to detect the number of sheets stacked on the sheet discharge portion. The detection piece can project from and retract into an opening formed in the sheet discharge portion. The actuator is rotated by the weight of the sheets stacked on the detection piece and one end of the actuator is detected by a detector such as an optical sensor.

If a state where only one sheet is discharged on the sheet discharge portion is detected by the detection piece as described above, a small load for rotating the actuator needs to be set in correspondence with the weight of one sheet. In this case, it is difficult to detect a fully stacked state of sheets by the same detection piece. As a result, a detection piece for detecting a fully stacked state is necessary in addition to the detection piece for detecting one sheet.

The present disclosure was made in view of the above problem and aims to detect a case where a small number of sheets are stacked on a sheet discharge portion and a case where a large number of sheets are stacked by a common detection piece.

SUMMARY

A sheet stacking device according to one aspect of the present disclosure includes a device main body, a sheet discharge unit, a sheet stacking portion, an opening and a sheet detector. The sheet discharge unit is arranged in the device main body and discharges sheets. The sheet stacking portion is arranged in the device main body and includes a sheet stacking surface on which the sheets discharged from the sheet discharge unit are to be stacked. The opening is formed in the sheet stacking surface. The sheet detector includes a detection piece capable of projecting upwardly of the sheet stacking surface from and retracting into the opening. The sheet detector detects a first state, a second state and a third state. The first state is a state where no sheet is placed on the sheet stacking surface. The second state is a state where a first number of the sheets discharged from the sheet discharge unit are placed on the sheet stacking surface. The third state is a state where a second number of the sheets, the second number being larger than the first number, are placed on the sheet stacking surface.

Further, an image forming apparatus according to another aspect of the present disclosure includes an image forming unit and the above sheet stacking device. The image forming unit forms an image on a sheet.

These and other objects, features and advantages of the present disclosure will become more apparent upon reading the following detailed description along with the accompanying drawings.

DETAILED DESCRIPTION

Figure 1:
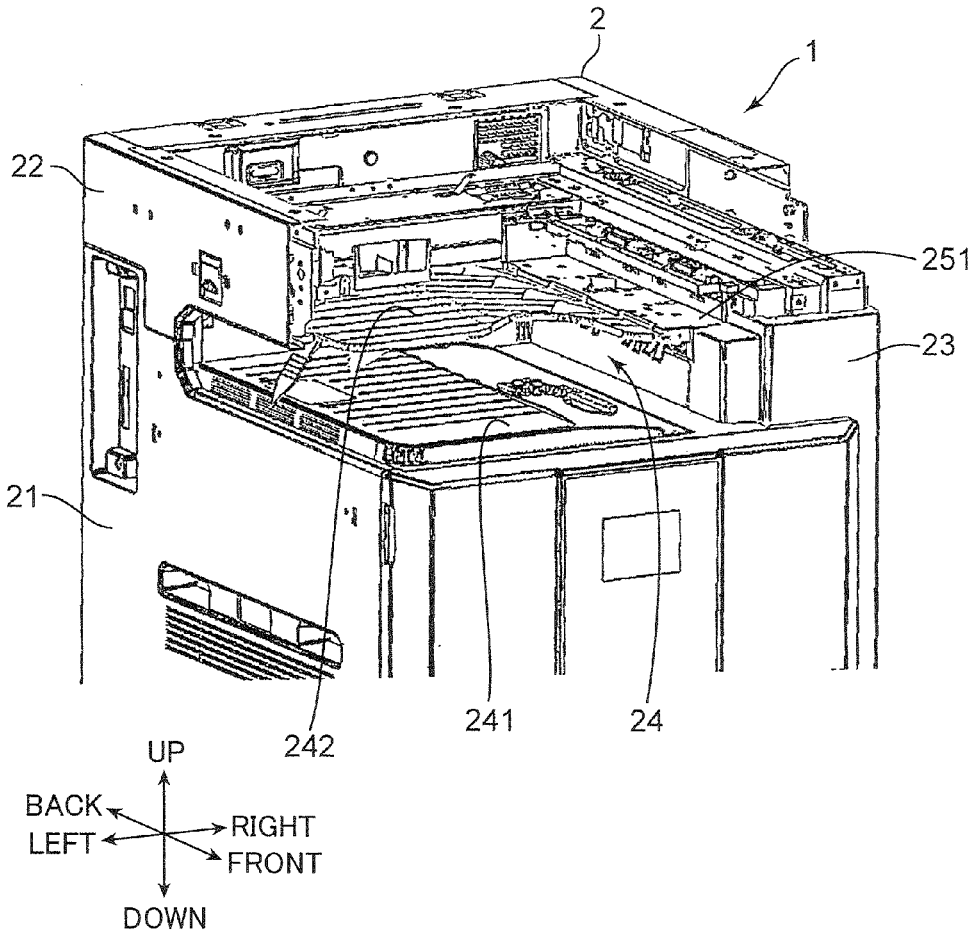
FIG. 1 is a perspective view of an image forming apparatus according to an embodiment of the present disclosure.
Figure 2:
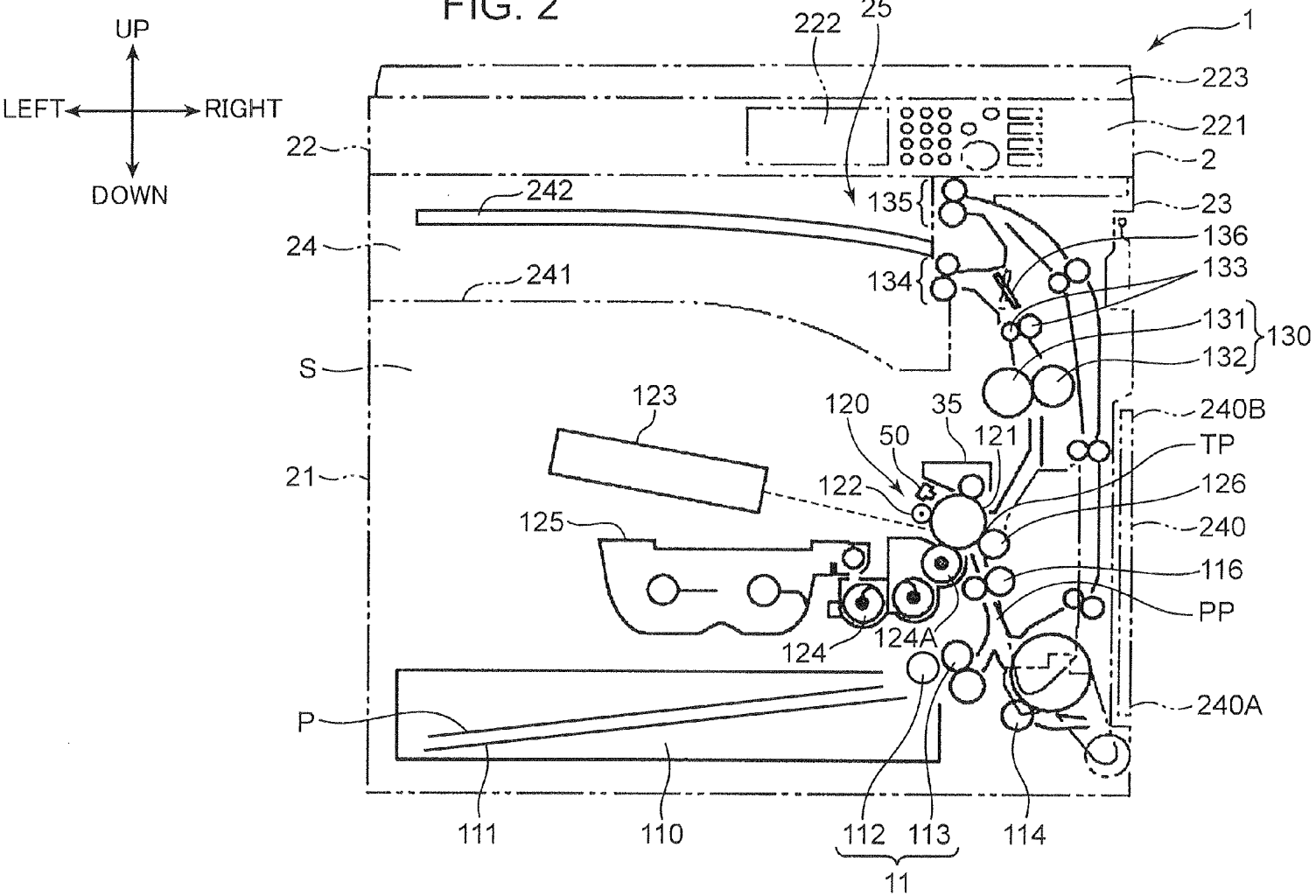
FIG. 2 is an internal sectional view of the image forming apparatus according to the embodiment of the present disclosure.
Figure 3:
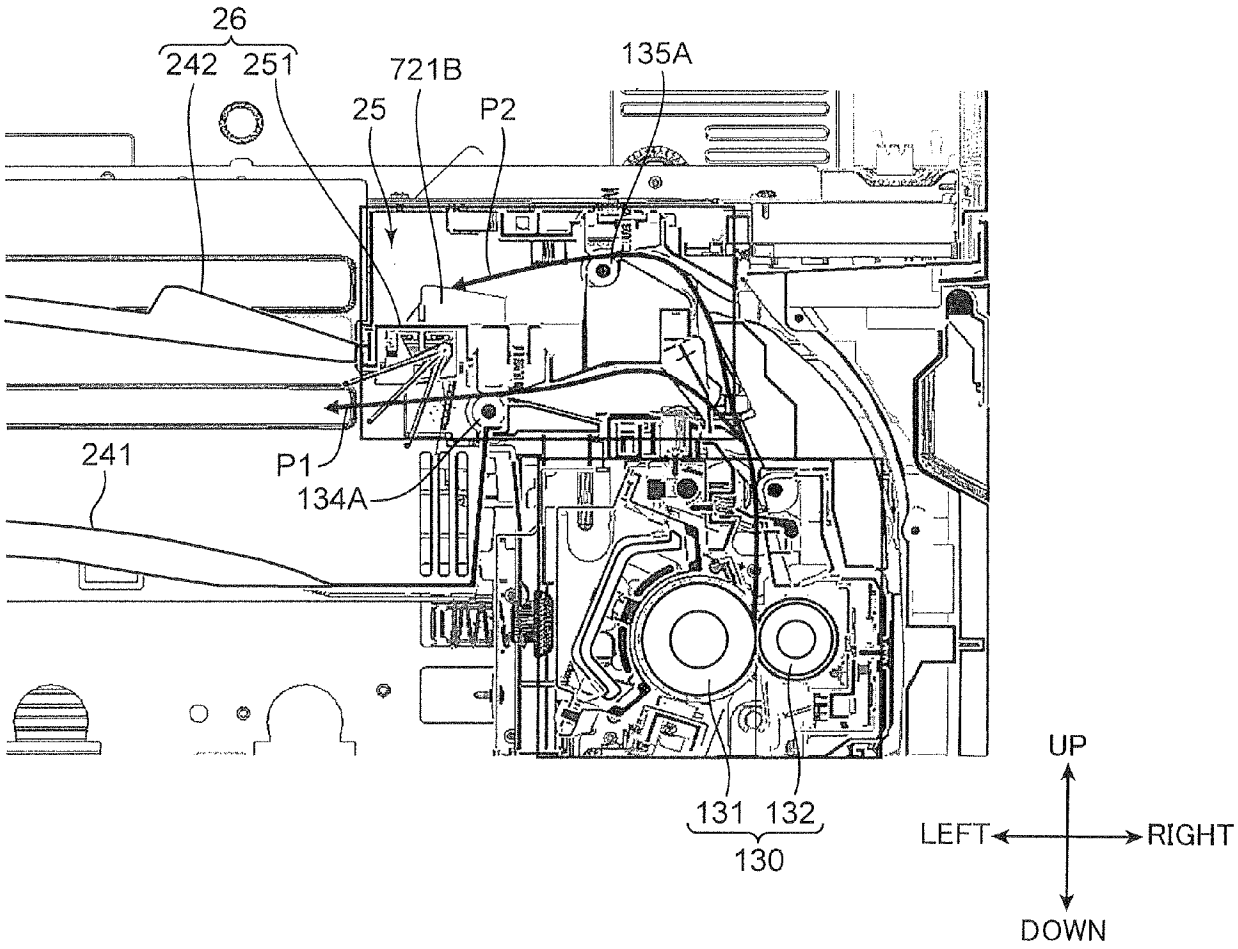
FIG. 3 is a sectional view enlargedly showing a part of the image forming apparatus according to the embodiment of the present disclosure.
Figure 4:
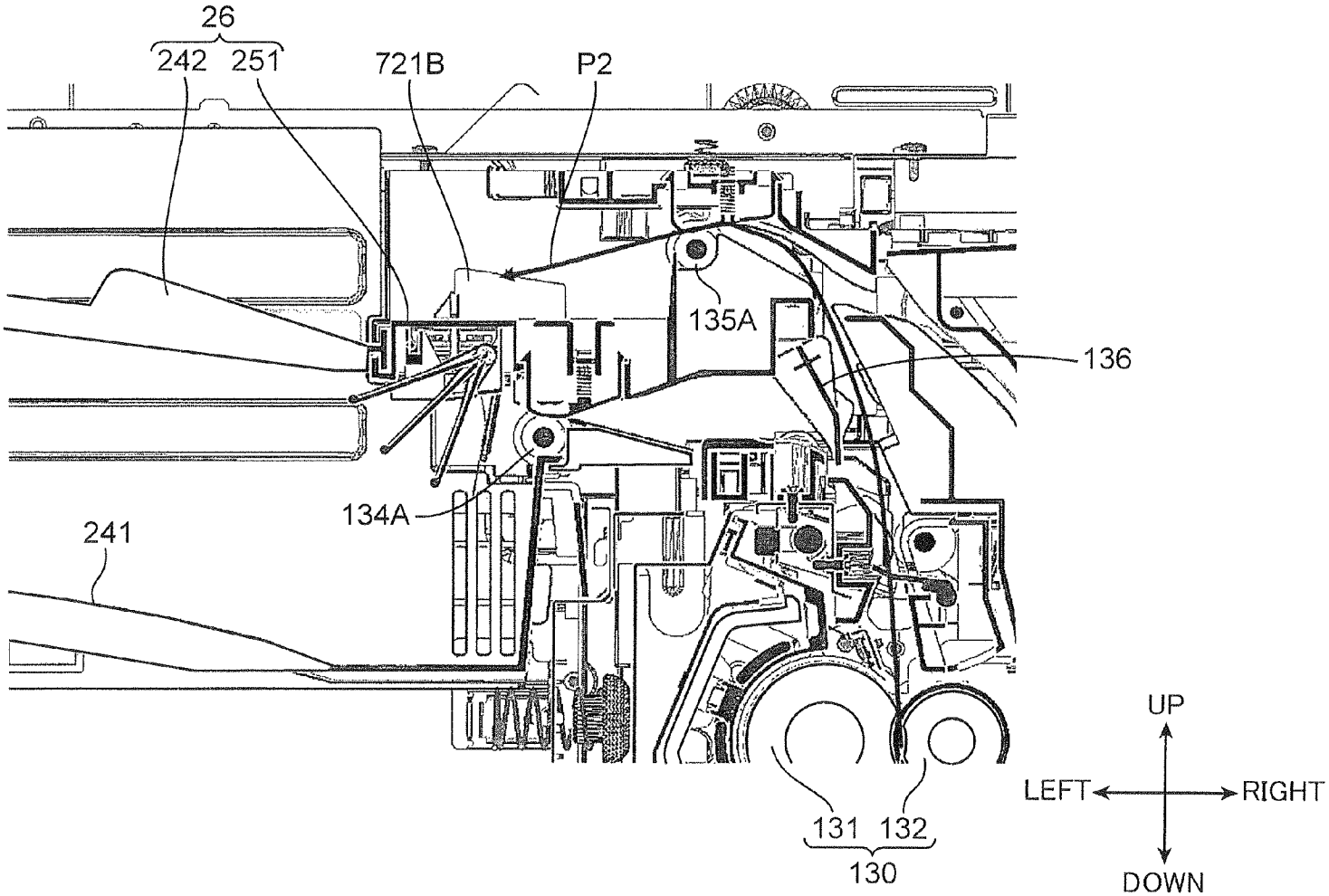
FIG. 4 is a sectional view enlargedly showing a part of FIG. 3.

Hereinafter, one embodiment of the present disclosure is described with reference to the drawings. FIG. 1 is an external perspective view of an image forming apparatus 1 according to one embodiment of the present disclosure. FIG. 2 is an internal sectional view of the image forming apparatus 1. FIGS. 3 and 4 are sectional views enlargedly showing apart of the image forming apparatus 1, i.e. a sheet discharge path for a sheet, to which a fixing process was applied in a fixing device 130. Although the image forming apparatus 1 shown in FIG. 1 and FIG. 2 is a so-called black-and-white complex machine, it may be another apparatus for forming a toner image or an ink image on a sheet such as a color complex machine, a color printer or a facsimile machine in another embodiment. Note that direction-indicating terms such as "upper" and "lower", "front" and "back", "left" and "right" used in the following description are merely for the purpose of clarifying the description and do not limit the principle of the image forming apparatus at all. Further, in the following description, a term "sheet" means a copy sheet, a coated paper, an OHP sheet, a cardboard, a postcard, a tracing paper or another sheet material to which an image forming process is to be applied or still another sheet material to which an arbitrary process other than the image forming process is to be applied.

The image forming apparatus 1 includes a substantially rectangular parallelepipedic main housing 2. The main housing 2 includes a substantially rectangular parallelepipedic lower housing 21, a substantially rectangular parallelepipedic upper housing 22 arranged above the lower housing 21, and a coupling housing 23 (apparatus main body) coupling the lower housing 21 and the upper housing 22. The coupling housing 23 extends along the right and back edges of the main housing 2. Sheets P having a printing process applied thereto are discharged to a discharge space 24 enclosed by the lower housing 21, the upper housing 22 and the coupling housing 23. Particularly, in this embodiment, the sheets P are discharged onto a sheet discharge portion 241 arranged on an upper surface portion of the lower housing 21 and a sheet discharge tray 242 arranged above the sheet discharge portion 241.

An operation unit 221 arranged on the front side of the upper housing 22 includes, for example, an LCD touch panel 222. The operation unit 221 is so formed that information on the image forming process can be entered. A user can, for example, enter the number of sheets P to be printed, print density and the like through the LCD touch panel 222. Devices for reading a document image and an electronic circuit in charge of an overall control of the image forming apparatus 1 are mainly housed in the upper housing 22.

A pressing cover 223 arranged on the upper housing 22 is used to press a document. The pressing cover 223 is vertically rotatably mounted on the upper housing 22. The user rotates the pressing cover 223 upward to place a document on the upper housing 22. Thereafter, the user can operate the operation unit 221 to cause devices arranged in the upper housing 22 to read an image of the document.

A manual feed tray 240 (FIG. 2) is arranged on the right surface of the lower housing 21. The manual feed tray 24 is rotatable about a lower end 240A to move an upper end 240B upward and downward. When the manual feed tray 240 is rotated downward and located at a position to project to the right of the lower housing 21, the user can place a sheet P on the manual feed tray 24. The sheet P on the manual feed tray 240 has an image forming process applied thereto and is discharged to the discharge space 24 after being pulled into the lower housing 21 based on an instruction entered by the user through the operation unit 221. Further, an inner space S in which various devices to be described later are arranged is formed in the lower housing 21 (FIG. 2).

The image forming apparatus 1 includes a cassette 110, a sheet feeding unit 11, a second feed roller 114, a registration roller pair 116 and an image forming unit 120 (image forming portion) in the inner space S. The sheet feeding unit 11 includes a pickup roller 112 and a first feed roller 113. The sheet feeding unit 11 feeds a sheet P to a sheet conveyance path PP. The sheet conveyance path PP is a conveyance path arranged to pass through a transfer position TP arranged in the image forming unit 120 by way of the registration roller pair 116.

The cassette 110 stores sheets P inside. The cassette 110 can be pulled out in a forward direction (direction forward of the plane of FIG. 2) from the lower housing 21. The sheet P stored in the cassette 110 is fed upward in the lower housing 21. Thereafter, the sheet P has an image forming process applied thereto in the lower housing 21 and is discharged to the discharge space 24 based on an instruction entered by the user through the operation unit 221. The cassette 110 includes a lift plate 111 for supporting the sheets P. The lift plate 111 is inclined to push the leading end edges of the sheets P upward.

The pickup roller 112 is arranged above the leading end edges of the sheets P pushed upward by the lift plate 111. When the pickup roller 112 rotates, the sheet P is pulled out from the cassette 110.

The first feed roller 113 is arranged downstream of the pickup roller 112 in a sheet conveying direction. The first feed roller 113 feeds the sheet P to a further downstream side in the sheet conveying direction. The second feed roller 114 is arranged inwardly of the lower end 240A of the manual feed tray 240. The second feed roller 114 conveys a sheet P on the manual feed tray 240 into the lower housing 21. The user can selectively use the sheets P stored in the cassette 110 or the sheet P placed on the manual feed tray 240.

The registration roller pair 116 specifies the position of the sheet P in a direction perpendicular to the sheet conveying direction. In this way, the position of an image formed on the sheet P is adjusted. The registration roller pair 116 forms a nip portion between the rollers. The registration roller pair 116 conveys the sheet P to the image forming unit 120 in accordance with a transfer timing of a toner image to the sheet P in the image forming unit 120. Further, the registration roller pair 116 has a function of correcting oblique feed (skew) of the sheet P.

The image forming unit 120 includes a photoconductive drum 121, a charger 122, an exposure device 123, a developing device 124, a toner container 125, a transfer roller 126, a cleaning device 35 and a charge remover 50.

The photoconductive drum 121 has a substantially cylindrical shape. An electrostatic latent image is formed on the circumferential surface of the photoconductive drum 121 and a toner image corresponding to this electrostatic latent image is carried on this circumferential surface.

The charger 122 has a predetermined voltage applied thereto and substantially uniformly charges the circumferential surface of the photoconductive drum 121. The exposure device 123 irradiates laser light to the circumferential surface of the photoconductive drum 121 charged by the charger 122. This laser light is irradiated in accordance with image data output from an external apparatus (not shown) such as a personal computer communicably connected to the image forming apparatus 1. As a result, an electrostatic latent image corresponding to the image data is formed on the circumferential surface of the photoconductive drum 121.

The developing device 124 supplies toner to the circumferential surface of the photoconductive drum 121 on which an electrostatic latent image is formed. The toner container 125 supplies the toner to the developing device 124. The toner container 125 supplies the toner to the developing device 124 successively or as needed. When the developing device 124 supplies the toner to the photoconductive drum 121, the electrostatic latent image formed on the circumferential surface of the photoconductive drum 121 is developed (visualized). As a result, a toner image is formed on the circumferential surface of the photoconductive drum 121. The developing device 124 includes a developing roller 124A for bearing the toner on a circumferential surface. The developing roller 124A is arranged to face the photoconductive drum 121 at a developing position. The developing roller 124A supplies the toner to the photoconductive drum 121 by being driven and rotated.

The transfer roller 126 is arranged to face the circumferential surface of the photoconductive drum 121 at the transfer position TP. The transfer roller 126 is driven and rotated in the same direction as the photoconductive drum 121 at the transfer position TP. At the transfer position TP, a toner image formed on the circumferential surface of the photoconductive drum 121 is transferred to a sheet P.

The cleaning device 35 removes the toner remaining on the circumferential surface of the photoconductive drum 121 after a toner image is transferred to a sheet P. The charge remover 50 irradiates predetermined charge removing light to the photoconductive drum 121 whose circumferential surface was cleaned by the cleaning device 35. As a result, a potential on the circumferential surface of the photoconductive drum 121 is made uniform.

The circumferential surface of the photoconductive drum 121 cleaned by the cleaning device 35 and having electric charges removed by the charge remover 50 passes below the charger 122 again, thereby being uniformly charged. Thereafter, a new toner image is formed in the aforementioned manner.

The image forming apparatus 1 further includes the fixing device 130 at a side downstream of the image forming unit 120 in the conveying direction for fixing a toner image on a sheet P. The fixing device 130 includes a heating roller 131 for melting the toner on the sheet P and a pressure roller 132 for bringing the sheet P into close contact with the heating roller 131. When the sheet P passes between the heating roller 131 and the pressure roller 132, the toner image is fixed to the sheet P.

With reference to FIGS. 3 and 4 in addition to FIG. 2, the image forming apparatus 1 further includes a conveyor roller pair 133 arranged downstream of the fixing device 130, a switching portion 136 arranged downstream of the conveyor roller pair 133, a lower discharge roller pair 134 and an upper discharge roller pair 135. The conveyor roller pair 133 conveys a sheet P having a fixing process applied thereto by the fixing device 130 to a downstream side in the sheet conveying direction. The switching portion 136 has a function of switching the conveying direction of the sheet P at a side downstream of the conveyor roller pair 133 in the sheet conveying direction. The lower discharge roller pair 134 is arranged to the left of the switching portion 136 and discharges a sheet P conveyed by the conveyor roller pair 133 to the sheet discharge portion 241 (arrow P1 of FIG. 3). The upper discharge roller pair 135 is arranged above the lower discharge roller pair 134 in the coupling housing 23 and discharges a sheet P conveyed by the conveyor roller pair 133 to the sheet discharge tray 242 mounted above the sheet discharge portion 241 (arrow P2 of FIGS. 3 and 4). Note that a first lower discharge roller 134A and a first upper discharge roller 135A arranged below in the lower and upper discharge roller pairs 134, 135 are respectively shown in FIGS. 3 and 4.

Further, the image forming apparatus 1 includes an upper discharge surface 26 (sheet stacking portion). The upper discharge surface 26 is arranged in the coupling housing 23. A sheet P discharged from the upper discharge roller pair 135 is stacked on the upper discharge surface 26. The upper discharge surface 26 includes a sheet stacking surface on which the sheet P is stacked. The upper discharge surface 26 is composed of the above sheet discharge tray 242 and an upper plate 251. The upper plate 251 is arranged in the coupling housing 23 and constitutes apart of the coupling housing 23. Further, the sheet discharge tray 242 is detachably attached to a left end part of the upper plate 251. Discharge ribs 242A are arranged on an upper surface portion of the sheet discharge tray 242 (see FIG. 5). The discharge rib 242A is a substantially triangular rib member and a plurality of discharge ribs 242A are arranged at intervals in forward and backward directions. The discharge ribs 242A have a function of aligning trailing end parts of a plurality of sheets P discharged from the upper discharge roller pair 135.

In this embodiment, an upper discharge unit 25 (FIG. 2, sheet stacking device) is configured by the upper discharge roller pair 135, the upper discharge surface 26 and a sheet detector 7 to be described later. The upper discharge unit 25 can function as a so-called job separator. Specifically, when an image is formed on the underside of a sheet P at the time of duplex printing, the sheet P finished with a fixing process on the top side is switched back after being temporarily discharged to the upper discharge unit 25, and then conveyed to the image forming unit 120 again. It is also possible to selectively discharge sheets P having an image formed thereon using copy and print functions to the sheet discharge portion 241 and, on the other hand, discharge sheets having an image formed thereon using a FAX function to the upper discharge unit 25.

Figure 5:
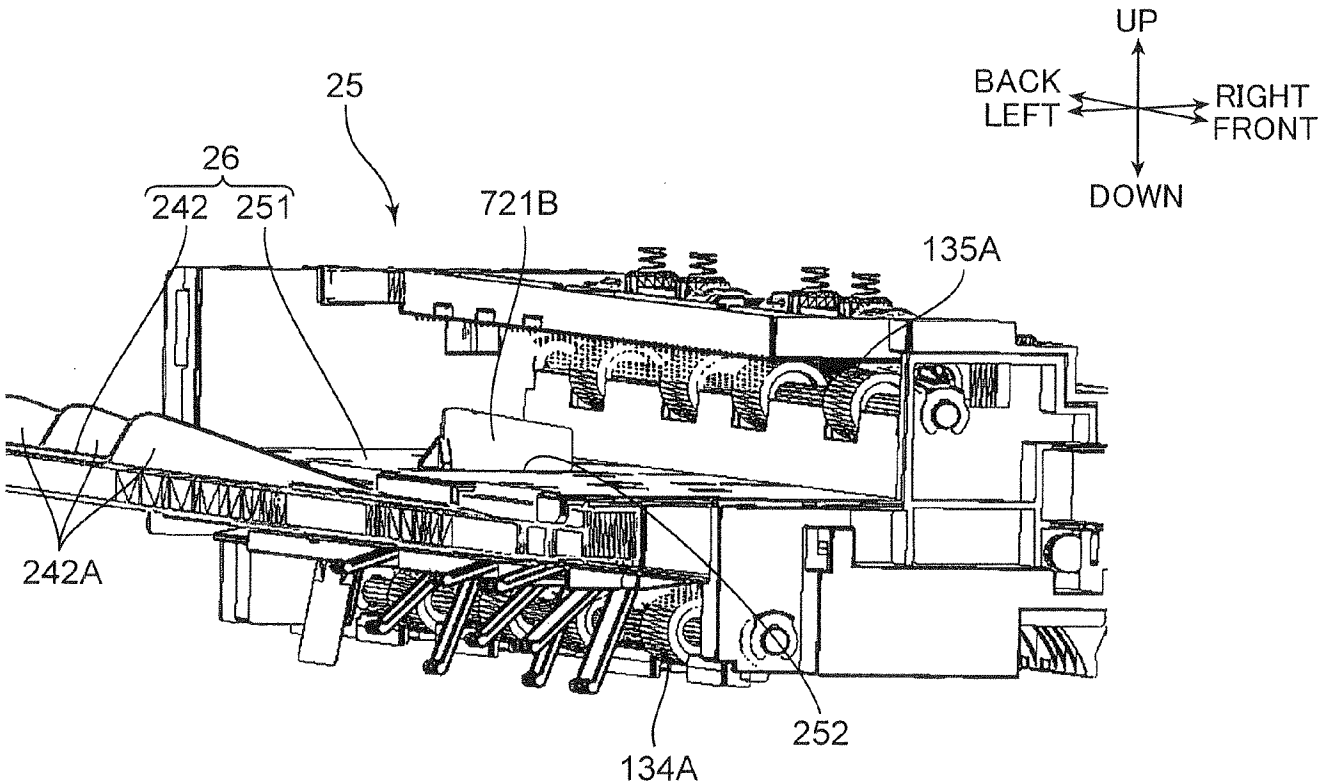
FIG. 5 is a perspective view showing a sheet discharge unit of the image forming apparatus according to the embodiment of the present disclosure.
Figure 6A:
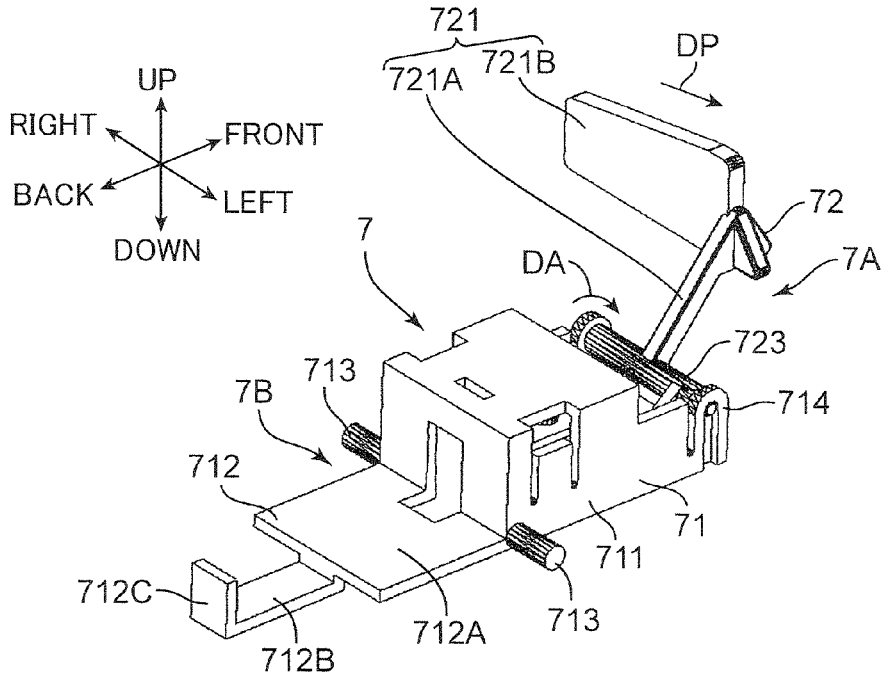
FIG. 6A is a perspective view showing a sheet detector according to the embodiment of the present disclosure and FIG. 6B is a sectional view showing the sheet detector according to the embodiment of the present disclosure.
Figure 6B:
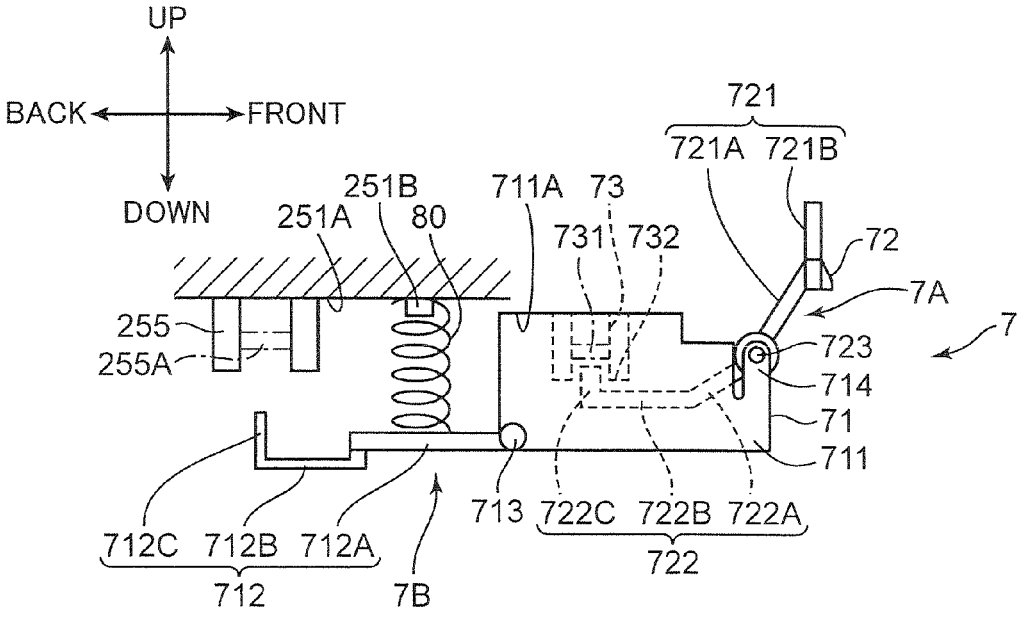

The upper discharge unit 25 includes the sheet detector 7. Next, the sheet detector 7 is described in detail with reference to FIGS. 5 and 6. FIG. 5 is a perspective view of the sheet detector 7 according to this embodiment. FIG. 6A is a perspective view of the sheet detector 7 according to this embodiment and FIG. 6B is a sectional view of the sheet detector 7. The sheet detector 7 includes a sheet detection piece 721B (detection piece) and detects a state of a sheet P discharged to the upper discharge surface 26. The sheet detection piece 721B can project upward from and retract into the upper discharge surface 26 through an opening 252 formed in the upper plate 251. The sheet detector 7 detects a first state where no sheet P is placed on the upper discharge surface 26, a second state where a first number of sheets P discharged from the upper discharge roller pair 135 are placed on the upper discharge surface 26 and a third state where a second number of sheets, the second number being larger than the first number, are placed on the upper discharge surface 26. Note that, in this embodiment, the first number is set to be 1 to 49 and the second number is set to be a maximum stackable amount (50 sheets) of the upper discharge surface 26. The second state is a state where at least one sheet has been discharged to the upper discharge unit 25.

The sheet detector 7 is arranged below the upper plate 251. Specifically, only the aforementioned sheet detection piece 721B appears on an upper surface portion of the upper plate 251 and the other part of the sheet detector 7 is arranged inwardly of the upper plate 251. With reference to FIGS. 6A and 6B, the sheet detector 7 includes a first sheet detector 7A and a second sheet detector 7B.

The first sheet detector 7A is provided with a rotatable actuator 72 including the sheet detection piece 721B, and a first detector 73. The first sheet detector 7A detects the first and second states described above according to the rotation of the actuator 72.

The actuator 72 includes a first arm portion 721, a second arm portion 722 and an actuator shaft portion 723 (first supporting point portion). With reference to FIG. 6A, the actuator shaft portion 723 is a shaft portion extending in a lateral direction. The actuator shaft portion 723 serves as a rotary shaft in the rotation of the actuator 72. In other words, the actuator 72 is rotatable about the actuator shaft portion 723. An unillustrated torsion coil spring for biasing the actuator 72 is provided on the actuator shaft portion 723 such that the sheet detection piece 721B projects upward from the opening 252. Note that a biasing force of the torsion coil spring is smaller than a load applied by one sheet to press the sheet detection piece 721B downward. Note that, as another embodiment, the center of gravity of the actuator 72 may be arranged at a position displaced from the actuator shaft portion 723, whereby a rotational moment centered on the actuator shaft portion 723 is applied to the actuator 72 and the sheet detection piece 721B projects upward from the opening 252.

The first arm portion 721 is an arm portion extending in a radial direction to a front-upper side from a lateral central part of the actuator shaft portion 723. The first arm portion 721 is composed of a first supporting portion 721A extending from the actuator shaft portion 723 and the aforementioned sheet detection piece 721B arranged on a tip part of the first supporting portion 721A. The sheet detection piece 721B is a plate-like member facing forward and backward in the first state. Note that the upper end edge of the sheet detection piece 721B is slightly inclined downward from left to right. When a sheet P is placed on the sheet detection piece 721B, the actuator 72 rotates about the actuator shaft portion 723.

With reference to FIG. 6B, the second arm portion 722 is an arm portion extending (in a radial direction different from the first arm portion) from the actuator shaft portion 723 on a side opposite to the first arm portion 721. Note that the second arm portion 722 is not shown in FIG. 6A since it is housed in a housing 71 to be described later. The second arm portion 722 is composed of a 21st supporting portion 722A, a 22nd supporting portion 722B and a first blocking portion 722C. In the aforementioned first state, the 21st supporting portion 722A extends to a rear-lower side from the actuator shaft portion 723. The 22nd supporting portion 722B is connected to a tip part of the 21st supporting portion 722A and extends backward. The first blocking portion 722C is connected to a tip part of the 22nd supporting portion 722B and extends upward.

The first detector 73 is housed in the housing 71 to be described later. The first detector 73 is arranged to face the first blocking portion 722C of the second arm portion 722. The first detector 73 is a light transmission type sensor arranged on a pair of wall portions and a light emitter and a light receiver are arranged on the pair of wall portions. As a result, a first light transmitting portion 731 which is an optical path is formed between the pair of wall portions. The first detector 73 detects the second arm portion 722 according to the rotation of the actuator 72. When the first blocking portion 722C of the second arm portion 722 is separated from the first light transmitting portion 731 of the first detector 73 and not blocking the light transmitting portion 731, the first detector 73 outputs a LOW signal to an unillustrated control unit. Further, when the first blocking portion 722C blocks the first light transmitting portion 731, the first detector 73 outputs a HIGH signal to the unillustrated control unit.

The second sheet detector 7B includes the housing 71, a second detector 255 and a compression spring 80. Further, the second sheet detector 7B rotatably supports the first sheet detector 7A. The second sheet detector 7B detects the aforementioned third state according to the rotation of the first sheet detector 7A.

The housing 71 includes a casing 711, a housing arm portion 712 (third arm portion) and a housing shaft portion 713 (second supporting point portion). With reference to FIG. 6A, the housing shaft portion 713 is a shaft portion extending in the lateral direction. The housing shaft portion 713 is inserted into unillustrated bearings arranged below the upper plate 251 in the coupling housing 23. The housing shaft portion 713 serves as a rotary shaft in the rotation of the housing 71. In other words, the housing 71 is rotatable about the housing shaft portion 713.

The housing arm portion 712 radially extends toward the back from the housing shaft portion 713. The housing arm portion 712 includes a plate portion 712A, an extending portion 712B and a second blocking portion 712C. The plate portion 712A is a plate-like member extending backward from the housing shaft portion 713. The extending portion 712B extends backward from a lateral central part of the plate portion 712A. The extending portion 712B has a width smaller than the plate portion 712A. The second blocking portion 712C is formed by bending a tip part of the extending portion 712B upward.

The casing 711 is arranged before the housing shaft portion 713 and has a box shape. Specifically, the casing 711 is arranged on a side of the housing shaft portion 713 opposite to (at a position circumferentially different from) the housing arm portion 712. The casing 711 is arranged to have substantially the same width as the plate portion 712A in the lateral direction. With reference to FIG. 6B, the casing 711 supports the aforementioned actuator 72 and first detector 73. Specifically, the actuator shaft portion 723 of the actuator 72 is inserted into bearing portions 714 formed on a front end part of the casing 711. As a result, the actuator 72 is rotatably supported on the housing 71. Further, the first detector 73 is fixed to a casing ceiling portion 711A (FIG. 6B) of the casing 11.

The second detector 255 is fixed to an upper plate lower surface portion 251A equivalent to an underside portion of the upper plate 251 (FIG. 6B). The second detector 255 is arranged to face the second blocking portion 712C of the housing arm portion 712. Similarly to the first detector 73, the second detector 255 is a light transmission type sensor arranged on a pair of wall portions and a light emitter and a light receiver are arranged on the pair of wall portions. As a result, a second light transmitting portion 255A which is an optical path is formed between the pair of wall portions. The second detector 255 detects the second blocking portion 712C according to the rotation of the housing 71. When the second blocking portion 712C of the housing arm portion 712 is separated from the second light transmitting portion 255A of the second detector 255, the second detector 255 does not block the second light transmitting portion 255A. At this time, the second detector 255 outputs a LOW signal to the unillustrated control unit. On the other hand, when the second blocking portion 712C blocks the second light transmitting portion 255A by a movement to be described later, the second detector 255 outputs a HIGH signal to the unillustrated control unit.

The compression spring 80 is arranged to be compressed between the upper plate lower surface portion 251A of the upper plate 251 and the housing arm portion 712 of the housing 71 in the coupling housing 23. The compression spring 80 is configured to bias the housing 71 so as to restrict the housing arm portion 712 to be rotated about the housing shaft portion 713 in the first and second state. Specifically, an upper end part of the compression spring 80 is fitted to a projection portion 251B projecting downward from the upper plate lower surface portion 251A of the upper plate 251, and a lower end part thereof is held in contact with the plate portion 712A of the housing arm portion 712 of the housing 71. When the housing 71 is supported in the coupling housing 23 rotatably about the housing shaft portion 713, the compression spring 80 biases the housing arm portion 712 of the housing 71 downward. In other words, the compression spring 80 biases the housing 71 in a direction to separate the housing arm portion 712 from the second detector 255.

Figure 7:
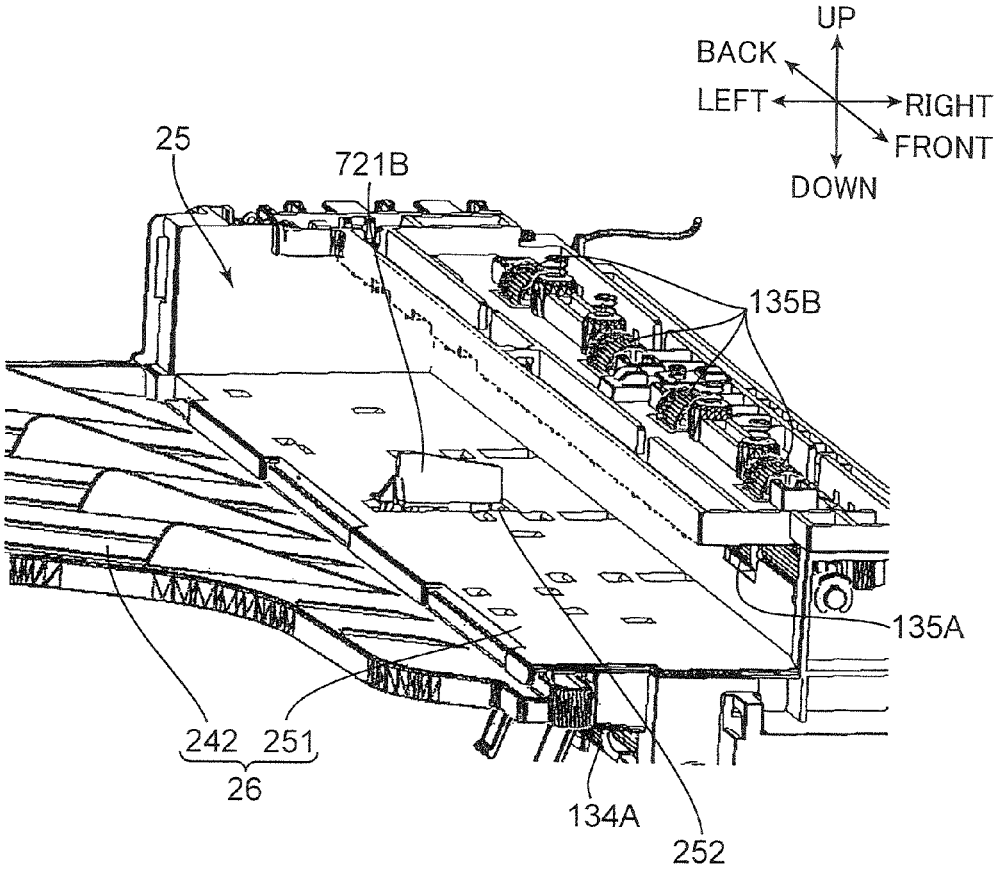
FIG. 7 is a perspective view showing a state (first state) where a detection piece is projecting in the sheet discharge unit according to the embodiment of the present disclosure.
Figure 8:
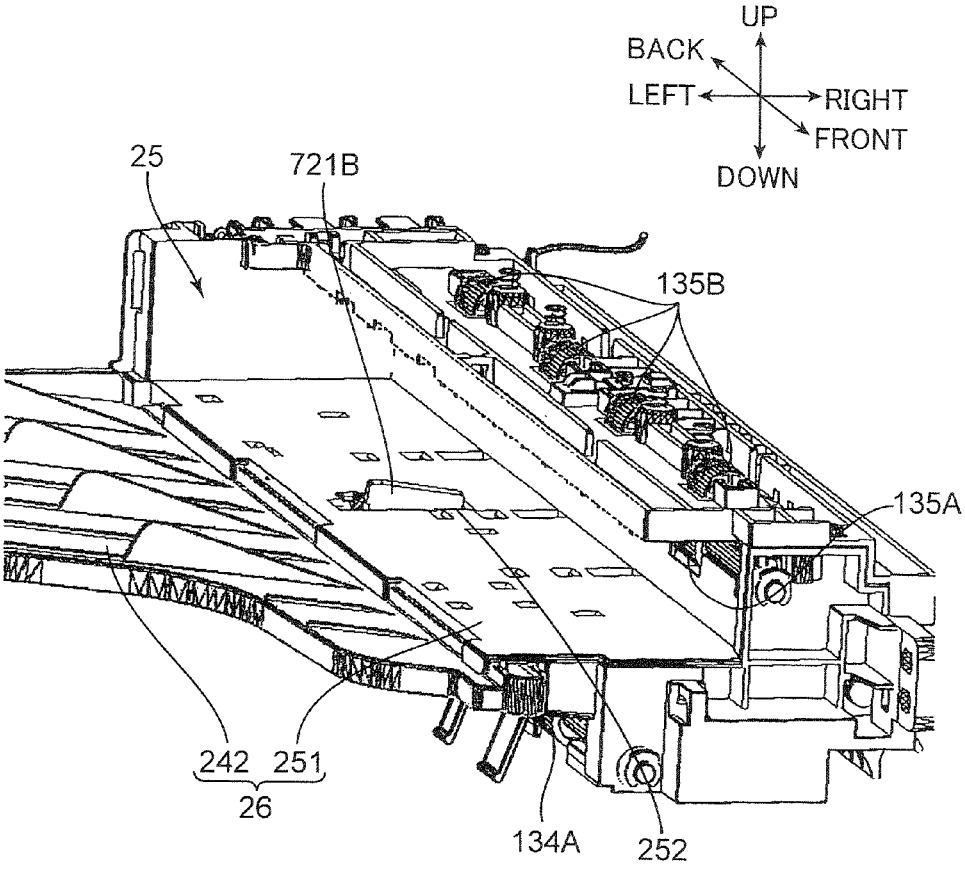
FIG. 8 is a perspective view showing a state (second state) where the detection piece is slightly projecting in the sheet discharge unit according to the embodiment of the present disclosure.
Figure 9:
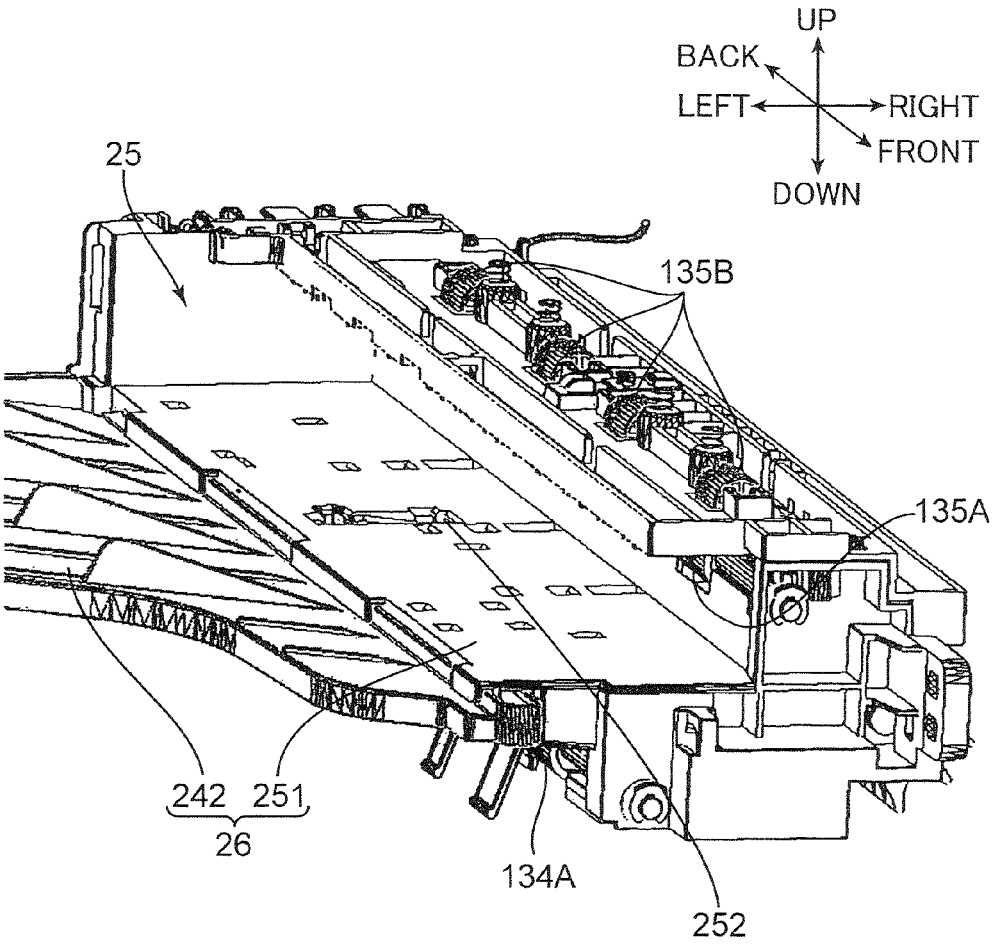
FIG. 9 is a perspective view showing a state (third state) where the detection piece is retracted in the sheet discharge unit according to the embodiment of the present disclosure.
Figure 10:
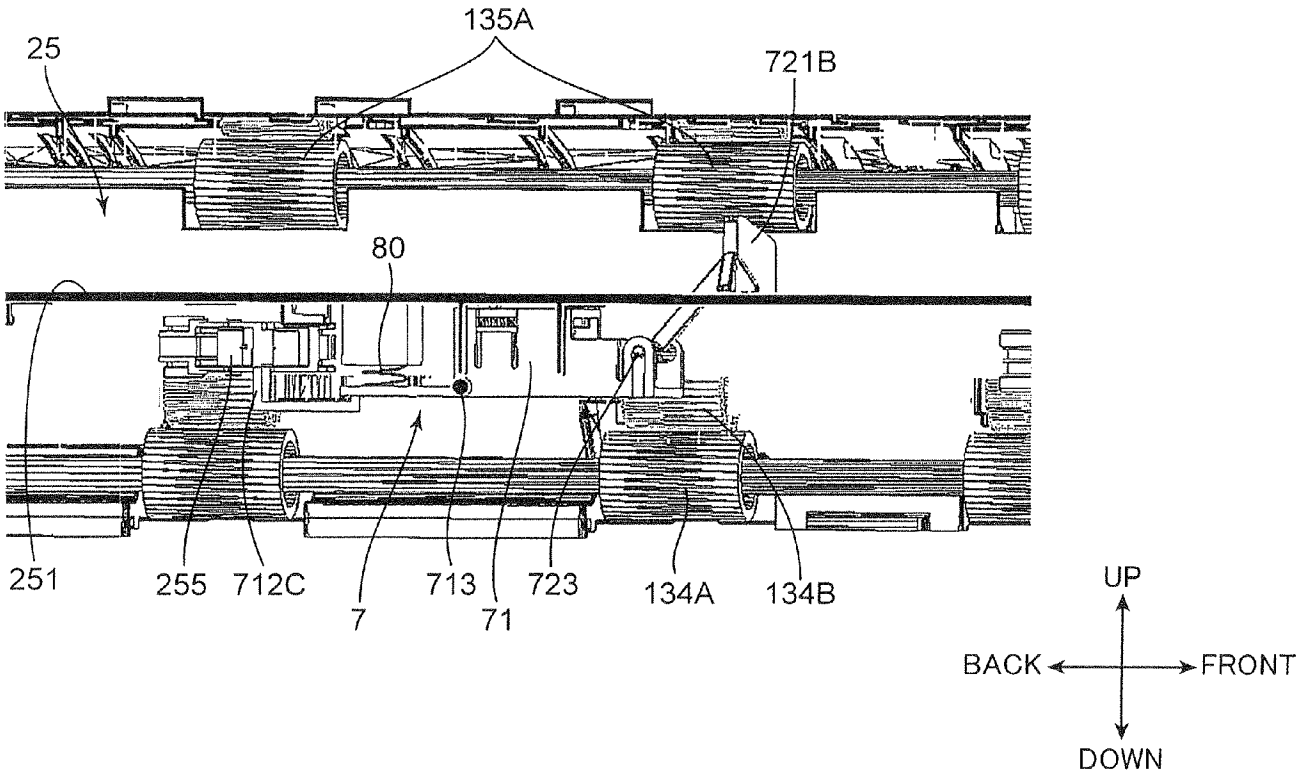
FIG. 10 is a sectional view of the sheet discharge unit in the state of FIG. 7.
Figure 11:
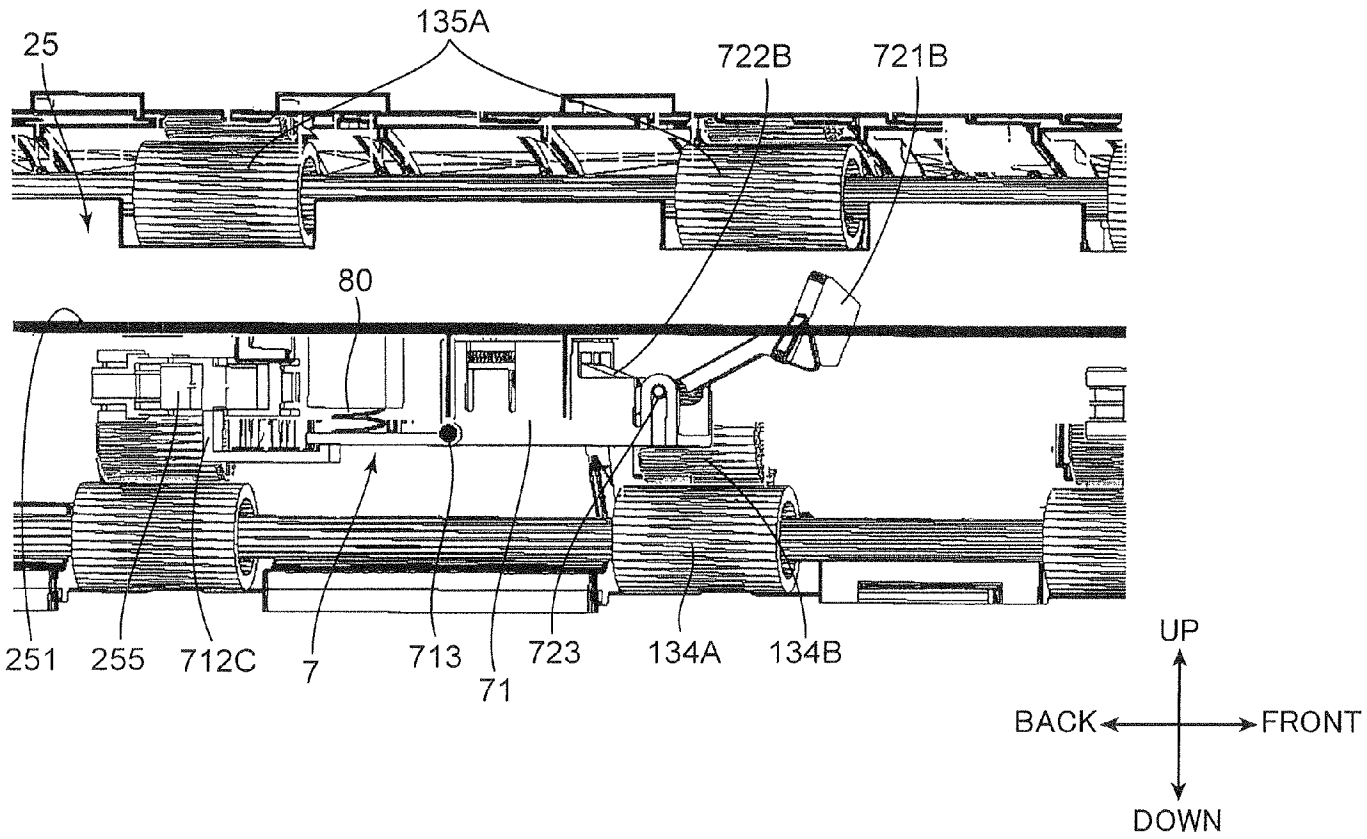
FIG. 11 is a sectional view of the sheet discharge unit in the state of FIG. 8.
Figure 12:
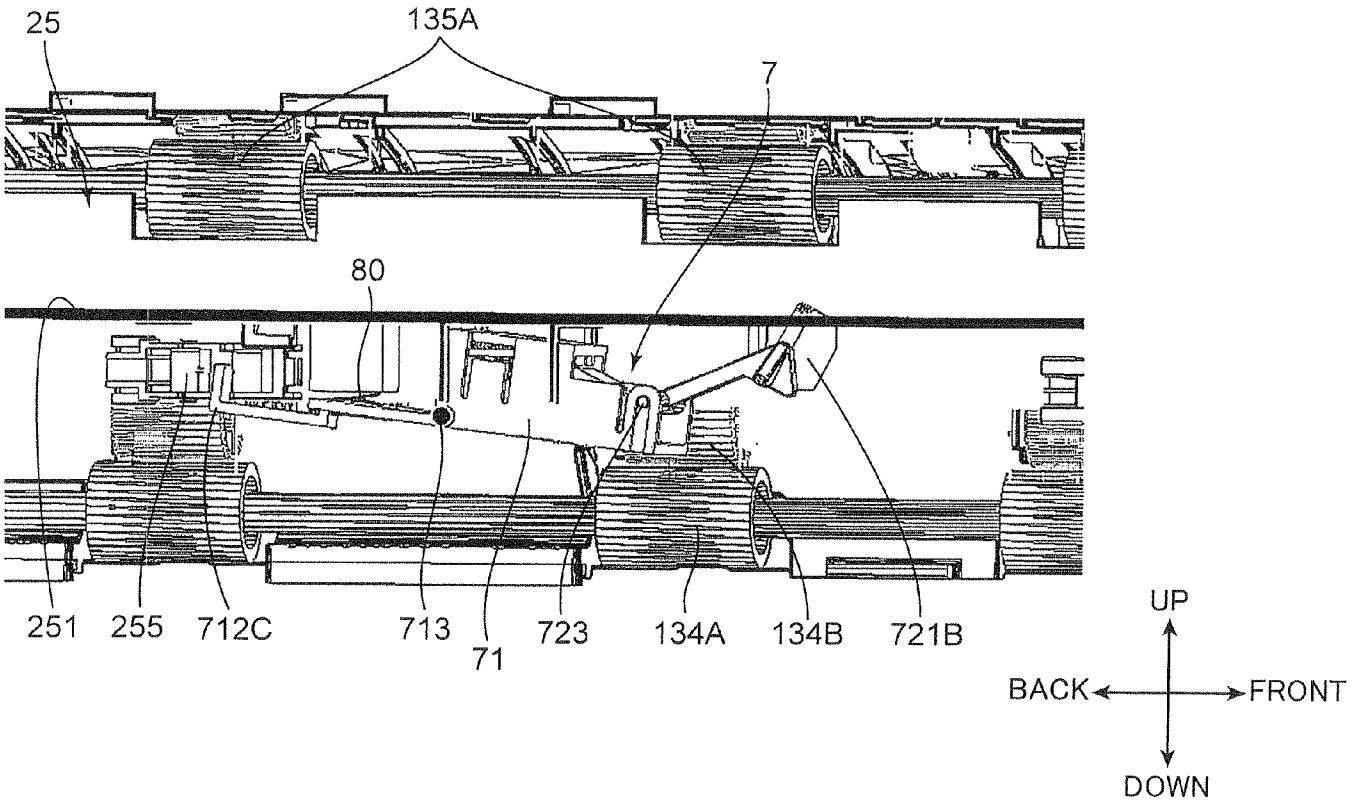
FIG. 12 is a sectional view of the sheet discharge unit in the state of FIG. 9.

Next, the operation of the sheet detector 7 is described in detail with reference to FIGS. 7 to 12. FIG. 7 is a perspective view showing a state where no sheet P is discharged to the upper discharge surface 26, i.e. a state where the sheet detection piece 721B is projecting on the sheet discharge surface 26 (first state). FIG. 8 is a perspective view showing a state where only one sheet P is discharged to the upper discharge surface 26, i.e. a state where the sheet detection piece 721B is slightly projecting on the upper discharge surface 26 (second state). FIG. 9 is a perspective view showing a state where 50 sheets P are discharged to the upper discharge surface 26 and the upper discharge surface 26 is in a full state, i.e. a state where the sheet detection piece 721B is retracted from the upper discharge surface 26 (third state). FIGS. 10 to 12 are sectional views of the upper discharge unit 25 in FIGS. 7 to 9 when viewed from a left side. Note that the sheets P are not shown in FIGS. 7 to 12.

With reference to FIGS. 6A, 6B, 7 and 10, the sheet detection piece 721B of the actuator 72 projects upward from the opening 252 of the upper plate 251 when no sheet P is discharged to the upper discharge surface 26. In the case, the first blocking portion 722C of the second arm portion 722 is arranged at a position separated downward from the first light transmitting portion 731 of the first detector 73 in the housing 71 as shown in FIG. 6B. Thus, the first detector 73 is not detecting the first blocking portion 722C. As a result, a LOW signal is output from the first detector 73 to the unillustrated control unit, whereby the control unit can judge that no sheet P is placed on the upper discharge surface 26. Specifically, the first state is detected. Further, the housing arm portion 712 of the housing 71 is biased downward by a biasing force of the compression spring 80. Thus, the second blocking portion 712C of the housing arm portion 712 is arranged at a position separated downward from the second light transmitting portion 255A of the second detector 255. In other words, the second detector 255 is not detecting the second blocking portion 712C.

On the other hand, when one sheet P is discharged from the upper discharge roller pair 135 and placed on the upper discharge surface 26, this one sheet P presses the sheet detection piece 721B downward against a biasing force of the torsion coil spring. Thus, the actuator 72 is rotated clockwise in FIG. 6B about the actuator shaft portion 723 (arrow DA of FIG. 6A). As a result, the sheet detector 7 is set in a state shown in FIGS. 8 and 11. Note that the sheet detection piece 721B of the actuator 72 is slightly projecting upward from the opening 252 of the upper plate 251 at this time. When the actuator 72 is rotated, the first blocking portion 722C of the second arm portion 722 approaches the first detector 73 to block the first light transmitting portion 731 of the first detector 73. As a result, the first detector 73 detects the first blocking portion 722C and outputs a HIGH signal to the control unit. Therefore, the control unit can judge that one sheet P has been placed on the upper discharge surface 26. Specifically, the second state is detected.

At the same time as the first blocking portion 722C blocks the first light transmitting portion 731 with the rotation of the actuator 72, the 22nd supporting portion 722B comes into contact with a wall portion 732 (FIG. 6B) of the first detector 73. Note that the first blocking portion 722C may extend longer upward than in FIG. 6B and the first blocking portion 722C may come into contact with the casing ceiling portion 711A. When the 22nd supporting portion 722B comes into contact with the wall portion 732 of the first detector 73, the actuator 72 and the housing 71 are integrally rotatable about the housing shaft portion 713. Note that, in the second state, a force of the compression spring 80 to bias the plate portion 712A downward is larger than a force of one sheet P to bias the sheet detection piece 721B downward. Thus, the second blocking portion 712 remains to be arranged at the position separated downward from the second detector 255 by the biasing force of the compression spring 80. Specifically, the second blocking portion 712C is not detected by the second detector 255 due to the biasing force of the compression spring 80.

When a sheet P is further discharged from the upper discharge roller pair 135, a plurality of sheets P are stacked on the upper discharge surface 26. As a result, the sheet detection piece 721B is pressed further downward by the weight of the plurality of sheets P and the actuator 72 further rotates from the second state. The housing 71 that keeps supporting the actuator 72 is rotated about the housing arm portion 713 while compressing the compression spring 80 until the number of sheets placed on the upper discharge surface 26 reaches the second number. Specifically, by a pressing force applied to the sheet detection piece 721B by the second number of sheets P, the second arm portion 722 comes into contact with the housing 71 and the housing 71 is rotated against the biasing force of the compression spring 80. As a result, the sheet detector 7 is set in a state shown in FIGS. 9 and 12. In this embodiment, the second blocking portion 712C approaches the second detector 255 to block the second light transmitting portion 255A when 50 sheets P, which is a maximum sheet stacking amount, are stacked on the upper discharge surface 26. As a result, the second detector 255 detects the second blocking portion 712C and outputs a HIGH signal to the control unit. Specifically, the control unit judges that 50 sheets P are placed on the upper discharge surface 26 and the upper discharge surface 26 has reached a full state, and detects the third state. In other words, when 1 to 49 sheets are stacked on the upper discharge surface 26, the second state is detected.

As described above, according to the above embodiment, the sheet detector 7 can detect the first, second and third states according to the number of sheets P placed on the sheet detection piece 721B that can project from and retract into the opening 252.

Further, the sheet detector 7 includes the first and second sheet detectors 7A, 7B. The first sheet detector 7A detects the first and second states. Further, the second sheet detector 7B supports the first sheet detector 7A and detects the third state. Thus, the first, second and third states can be detected according to the number of sheets P placed on the single sheet detection piece 721B.

The first sheet detector 7A is composed of the actuator 72 and the first detector 73. The actuator 72 includes the actuator shaft portion 723, the first arm portion 721 and the second arm portion 722. Further, the second sheet detector 7B is composed of the housing 71, the second detector 255 and the compression spring 80 (biasing portion). The housing 71 includes the housing shaft portion 713, the housing arm portion 712 and the casing 711 and supports the actuator shaft portion 723 and the first detector 73. In the first sheet detector 7A, the first detector 73 detects the first and second states by detecting the first blocking portion 722C. Further, in the second sheet detector 7B, the second detector 255 detects the third state by detecting the second blocking portion 712C.

Further, since no sheet P is placed on the sheet detection piece 721B in the first state, the actuator 72 is not rotated. Thus, the first blocking portion 722C is separated from the first detector 73, wherefore the first blocking portion 722C is not detected by the first detector 73. Further, when the first number of sheets P are placed on the sheet detection piece 721B, the actuator 72 is rotated and the first blocking portion 722C is detected by the first detector 73. Thus, the second state is detected. Furthermore, when the second number of sheets P are placed on the sheet detection piece 721B, the first blocking portion 722C comes into contact with the housing 71, whereby the actuator 72 and the housing 71 are integrally rotated. As a result, the second blocking portion 712C is detected by the second detector 255 and the third state is detected. Note that the number of stacked sheets based on which the first blocking portion 722C comes into contact with the housing 71 to integrally rotate the actuator 72 and the housing 71 may be 1 to 49. In this case, it is good if the second blocking portion 712C is not detected by the second detector 255.

Further, the upper discharge roller pair 135 discharges the sheet P in a first direction (lateral direction, arrow DP of FIG. 6A). On the other hand, the actuator 72 and the housing 71 are rotated in a cross-section including a second direction (forward and backward directions) intersecting with the first direction. In other words, the actuator 72 and the housing 71 are rotatable about the actuator shaft portion 723 and the housing shaft portion 713 extending in the first direction. Thus, a width taken up by the sheet detector 7 is reduced as much as possible in a discharging direction of the sheet P. Particularly, in the above embodiment, the sheet detector 7 is arranged at the inner side of the upper plate 251 constituting the upper discharge surface 26. Thus, the width of the upper plate 251 can be reduced in the sheet discharging direction (lateral direction). In other words, the lower discharge roller pair 134 and the upper discharge roller pair 135 can be arranged as close as possible in the lateral direction. As a result, the lateral width of the image forming apparatus 1 is reduced as much as possible.

Further, the total sheet weight largely differs between one sheet P and a full sheet stack. Even in such a case, according to the above embodiment, the placement of one sheet P on the upper discharge surface 26 and the fully stacked state on the upper discharge surface 26 are preferably detected by the single sheet detection piece 721B in the sheet detector 7.

Although the upper discharge unit 25 (sheet stacking device) according to the embodiment of the present disclosure and the image forming apparatus 1 provided with this are described above, the present disclosure is not limited to this. For example, the present disclosure can be modified as follows.

(1) Although the housing 71 and the actuator 72 are rotated in the cross-section intersecting with the discharging direction of the sheet P in the above embodiment, the present disclosure is not limited to this. The housing 71 and the actuator 72 may be rotated in a cross-section including the discharging direction (lateral direction) of the sheet P or the like.

(2) Further, although the first detector 73 and the second detector 255 are configured to include a light transmission type sensor in the above embodiment, the present disclosure is not limited to this. In another mode, the first detector 73 and the second detector 255 may detect the first blocking portion 722C and the second blocking portion 712C by other detectors such as piezoelectric elements.

(3) Further, although the first and second states are detected based on LOW and HIGH signals output from the first detector 73 and the third state is detected based on a HIGH signal output from the second detector 255 in the above embodiment, the present disclosure is not limited to this. In another embodiment, if the first detector 73 outputs a LOW signal and the second detector 255 outputs a HIGH signal, a failure in either one of the detectors may be judged by the control unit.

(4) Although the second state is a state where one sheet P is placed on the upper discharge surface 26 and the third state is a state where the maximum number of sheets P are placed on the upper discharge surface 26 in the above embodiment, the present disclosure is not limited to this. Specifically, the sheet detector 7 may detect a first state where no sheet P is placed on the upper discharge surface 26, a second state where a first number of sheets P are placed on the upper discharge surface 26 and a third state where a second number of sheets, the second number being larger than the first number, are placed on the upper discharge surface 26.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet stacking device, comprising:

a device main body;

a sheet discharge unit arranged in the device main body and configured to discharge sheets;

a sheet stacking portion arranged in the device main body and including a sheet stacking surface on which the sheets discharged from the sheet discharge unit are to be stacked;

an opening formed in the sheet stacking surface;

a sheet detector including:

a first sheet detector with a rotatable actuator that includes a detection piece capable of projecting upwardly out of the opening in the sheet stacking surface and retracting into the opening in the sheet stacking surface according to rotation of the actuator, the detection piece being capable of detecting a first state where no sheet is placed on the sheet stacking surface and a second state where a first number of the sheets discharged from the sheet discharge unit are placed on the sheet stacking surface; and a second sheet detector having a housing that is rotatably supported by the device main body, the housing of the second sheet detector rotatably supporting the actuator, the second sheet detector being capable of detecting a third state where a second number of the sheets are placed on the sheet stacking surface, with the second number being larger than the first number, the second sheet detector being capable of detecting the third state according to rotation of the housing with the actuator pressed by the second number of the sheets.

2. A sheet stacking device according to claim 1, wherein:

the first sheet detector includes:

the actuator provided with a first supporting portion serving as a rotary shaft, a first arm portion extending in a radial direction from the first supporting portion and including the detection piece and a second arm portion extending in a radial direction different from the first arm portion from the first supporting portion, and rotatable about the first supporting portion, and a first detector capable of detecting the second arm portion with the rotation of the actuator; and the second sheet detector includes:

the housing supported in the device main body, provided with a second supporting portion serving as a rotary shaft, a third arm portion extending in a radial direction from the second supporting portion and a casing arranged at a position different from the third arm portion in a circumferential direction relative to the second supporting portion and supporting the first supporting portion and the first detector, and rotatable about the second supporting portion, a second detector arranged in the device main body and capable of detecting the third arm portion according to the rotation of the housing, and a biasing portion arranged in the device main body and configured to bias the housing so as to restrict the third arm portion to be rotated about the second supporting portion in the first and second state.

3. A sheet stacking device according to claim 2, wherein:

in the first state, the second arm portion is arranged at a distance from the first detector, whereby the second arm portion is not detected by the first detector;

in the second state, the third arm portion is arranged at a distance from the second detector by a biasing force of the biasing portion, whereby the third arm portion is not detected by the second detector, and the actuator is rotated and the second arm portion is brought closer to the first detector by a pressing force applied to the detection piece by the first number of sheets, whereby the second arm portion is detected by the first detector; and in the third state, the actuator is further rotated from the second state to bring the second arm portion into contact with the housing to be rotated with the housing and the third arm portion is detected by the second detector by rotating the housing against the biasing force of the biasing portion by a pressing force applied to the detection piece by the second number of sheets.

4. A sheet stacking device according to claim 2, wherein:

the sheet discharge unit discharges the sheets in a first direction; and the actuator and the housing are rotatable about the first supporting portion and the second supporting portion extending in the first direction.

5. A sheet stacking device according to claim 1, wherein:

the first number is one and the second number is a maximum number of sheets to be stacked on the sheet stacking portion.

6. An image forming apparatus, comprising:

an image forming portion for forming images on sheets; and a sheet stacking device to which the sheets are to be discharged;

the sheet stacking device including:

a device main body;

a sheet discharge unit arranged in the device main body and configured to discharge sheets;

a sheet stacking portion arranged in the device main body and including a sheet stacking surface on which the sheets discharged from the sheet discharge unit are to be stacked;

an opening formed in the sheet stacking surface; and a sheet detector including:

a first sheet detector with a rotatable actuator that includes a detection piece capable of projecting upwardly out of the opening in the sheet stacking surface and retracting into the opening in the sheet stacking surface according to rotation of the actuator, the detection piece being capable of detecting a first state where no sheet is placed on the sheet stacking surface and a second state where a first number of the sheets discharged from the sheet discharge unit are placed on the sheet stacking surface; and a second sheet detector having a housing that is rotatably supported by the device main body, the housing of the second sheet detector rotatably supporting the actuator, the second sheet detector being capable of detecting a third state where a second number of the sheets are placed on the sheet stacking surface, with the second number being larger than the first number, the second sheet detector being capable of detecting the third state according to rotation of the housing with the actuator pressed by the second number of the sheets.

7. An image forming apparatus according to claim 6, wherein:

the first sheet detector includes:

the actuator provided with a first supporting portion serving as a rotary shaft, a first arm portion extending in a radial direction from the first supporting portion and including the detection piece and a second arm portion extending in a radial direction different from the first arm portion from the first supporting portion, and rotatable about the first supporting portion, and a first detector capable of detecting the second arm portion with the rotation of the actuator; and the second sheet detector includes:

the housing supported in the device main body, provided with a second supporting portion serving as a rotary shaft, a third arm portion extending in a radial direction from the second supporting portion and a casing arranged at a position different from the third arm portion in a circumferential direction relative to the second supporting portion and supporting the first supporting portion and the first detector, and rotatable about the second supporting portion, a second detector arranged in the device main body and capable of detecting the third arm portion according to the rotation of the housing, and a biasing portion arranged in the device main body and configured to bias the housing so as to restrict the third arm portion to be rotated about the second supporting portion in the first and second state.

8. An image forming apparatus according to claim 7, wherein:

in the first state, the second arm portion is arranged at a distance from the first detector, whereby the second arm portion is not detected by the first detector;

in the second state, the third arm portion is arranged at a distance from the second detector by a biasing force of the biasing portion, whereby the third arm portion is not detected by the second detector, and the actuator is rotated and the second arm portion is brought closer to the first detector by a pressing force applied to the detection piece by the first number of sheets, whereby the second arm portion is detected by the first detector; and in the third state, the actuator is further rotated from the second state to bring the second arm portion into contact with the housing to be rotated with the housing and the third arm portion is detected by the second detector by rotating the housing against the biasing force of the biasing portion by a pressing force applied to the detection piece by the second number of sheets.

9. An image forming apparatus according to claim 7, wherein:

the sheet discharge unit discharges the sheets in a first direction; and the actuator and the housing are rotatable about the first supporting portion and the second supporting portion extending in the first direction.

10. An image forming apparatus according to claim 6, wherein:

the first number is one and the second number is a maximum number of sheets to be stacked on the sheet stacking portion.

* * * * *